US006428277B1

(12) United States Patent
Holmes

(10) Patent No.: US 6,428,277 B1
(45) Date of Patent: Aug. 6, 2002

(54) HIGH SPEED, LOW TORQUE AXIAL FLOW FAN

(75) Inventor: William Holmes, London (CA)

(73) Assignee: Siemens VDO Automotive Inc., Mississauga (CA)

( * ) Notice: Subject to any disclaimer, the term of this patent is extended or adjusted under 35 U.S.C. 154(b) by 0 days.

(21) Appl. No.: 09/859,859

(22) Filed: May 17, 2001

(51) Int. Cl.[7] ..... F04D 29/38

(52) U.S. Cl. ..... 416/192; 416/189; 416/223 R; 416/243

(58) Field of Search ..... 416/169 A, 243, 416/DIG. 2, DIG. 5, 189, 234, 223 R, 192

(56) References Cited

U.S. PATENT DOCUMENTS 4,569,631 A * 2/1986 Gray, III ..... 416/169 A
4,569,632 A * 2/1986 Gray, III ..... 416/189
5,326,225 A * 7/1994 Gallivan et al. ..... 416/169 A
5,957,661 A * 9/1999 Hunt et al. ..... 416/169 A
6,315,521 B1 * 11/2001 Hunt ..... 416/192
6,350,104 B1 * 2/2002 Moreau et al. ..... 416/169 A
6,368,061 B1 * 4/2002 Capdevila ..... 416/169 A

* cited by examiner

*Primary Examiner*—F. Daniel Lopez
*Assistant Examiner*—Igor Kershteyn

(57) ABSTRACT

An axial flow fan 10 for producing airflow through an engine compartment of a vehicle includes a hub rotatable 12 about an axis 22. An annular band 16 is concentric with the hub and spaced radially outward from the hub. A plurality of fan blades 14 are distributed circumferentially around the hub and extend radially from the hub to the annular band. Each blade is constructed and arranged to ensure that the fan can operate at high speed and low torque.

10 Claims, 6 Drawing Sheets

HIGH SPEED, LOW TORQUE AXIAL FLOW FAN

FIELD OF THE INVENTION

The invention generally relates to axial flow fans for use in automotive cooling applications and, more particularly, to high speed, low torque axial flow fans.

BACKGROUND OF THE INVENTION

An axial flow fan may be used to produce a flow of cooling air through the heat exchanger components of a vehicle. For example, an airflow generator used in an automotive cooling application may include an axial flow fan for moving cooling air through a liquid-to-air heat exchanger such as an engine radiator, condenser, intercooler, or combination thereof. Often, axial flow fans are driven by electric motors, which, for a given speed, tend to operate most efficiently at low torque. The diameter of an engine cooling fan is often selected based on the radiator size: fans ranging from 250 mm to 600 mm can be used in typical automotive applications. Fans with small diameters (e.g., 300 mm) tend to rotate at higher speeds and at lower torques to obtain the same airflow as a fan with a large diameter (e.g., 500 mm).

Accordingly, there is a need to provide a large axial flow fan configured for operating at high speed yet at low torque to improve module efficiency by allowing the motor driving the fan to operate more efficiently when a small diameter fan cannot be used.

SUMMARY OF THE INVENTION

An object of the invention is to fulfill the need referred to above. In accordance with the principles of the present invention, this objective is achieved by providing an axial flow fan characterized by operating at high speed and low torque for producing airflow through an engine compartment of a vehicle. The fan includes a hub rotatable about an axis. An annular band is concentric with the hub and spaced radially outward from the hub. A plurality of fan blades are distributed circumferentially around the hub and extend radially from the hub to the annular band. Each blade has substantially the parameters defined by

| Blade Section Radius/Tip Radius $r = R/R_{tip}$ | Stagger $\xi$ Degrees | Solidity $\sigma$ |
|---|---|---|
| 38.5% | 76.0 | 0.522 |
| 46.6% | 72.0 | 0.490 |
| 52.7% | 71.5 | 0.470 |
| 57.8% | 70.7 | 0.452 |
| 63.0% | 71.1 | 0.432 |
| 68.1% | 72.0 | 0.410 |
| 73.3% | 72.9 | 0.385 |
| 78.4% | 73.9 | 0.359 |
| 83.6% | 74.4 | 0.332 |
| 88.7% | 75.1 | 0.302 |
| 93.9% | 76.7 | 0.267 |
| 100.0% | 78.6 | 0.225 |

wherein r is the non-dimensional radius from the rotational axis, ($r=R/R_{tip}$ with R being the radius from the rotational axis and $R_{tip}$ being the radius from the rotational axis at the blade tip), $\xi$ is the stagger angle of the blade at the radial distance R, and $\sigma$ is the solidity C/S, with C being chord length and S being the circumferential blade spacing at the radial distance R.

The fan is configured for operating at high speed yet at low torque to improve module efficiency by allowing the motor driving the fan to operate more efficiently when a small diameter fan cannot be used.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE PREFERRED EMBODIMENT

The invention relates to a vehicle cooling system including a heat exchanger, such as an engine coolant radiator or air conditioner heat exchanger, configured to transfer heat from a vehicle system, and a powered fan configured to move air through the heat exchanger. The fan includes fan blades which extend radially and axially and are configured to produce an airflow when rotated about a rotational axis.

Figure 2:
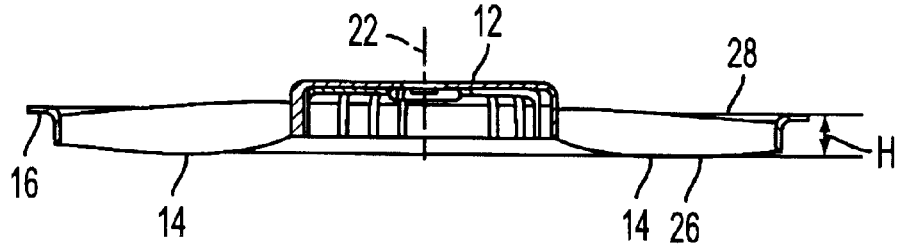
FIG. 2 is a cross-sectional view taken along the line 2—2 of FIG. 1.
Figure 3:
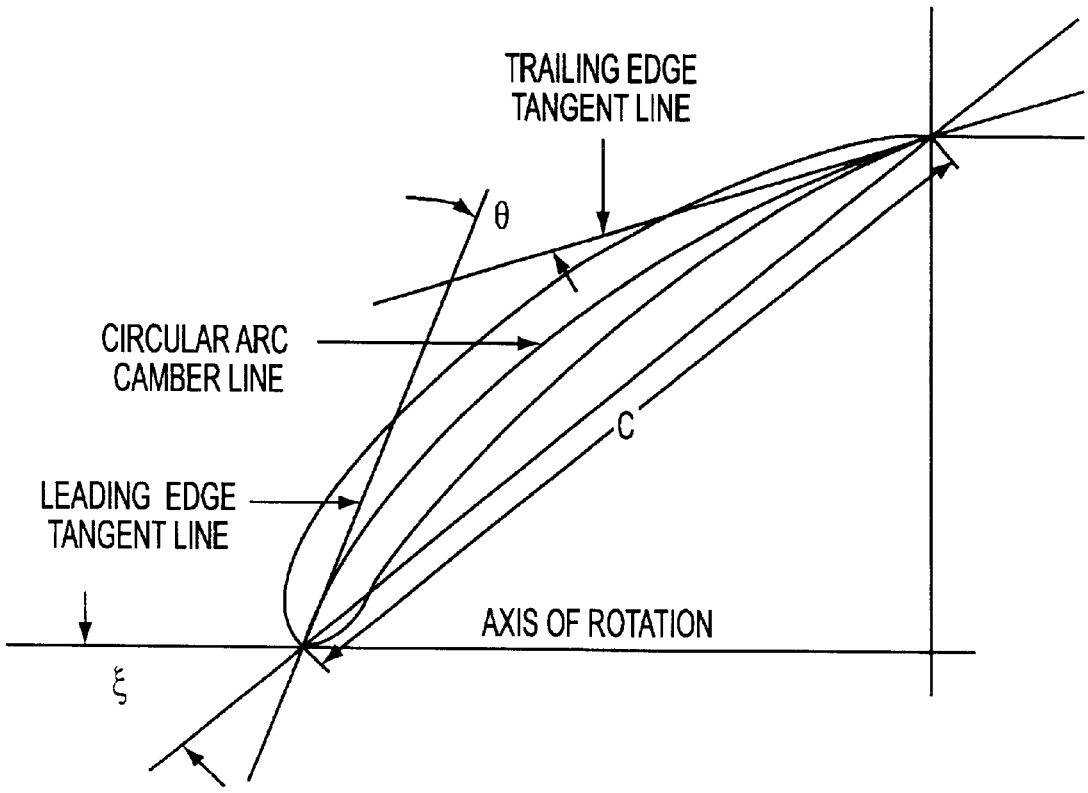
FIG. 3 depicts some of the relationships between and among several of the geometric parameters of a fan blade of the invention.

Fan design terminology used herein will be described with reference to FIG. 3. C, chord length, is the length of the shortest line joining the end points of the camber line that lies on the cylinder surface concentric with the axis of rotation and at radius R, the radial distance from the axis of rotation. $\xi$ is the stagger angle of a blade section, that is, the angle in degrees between the axis of rotation and the chord line. The blade is identified as having a leading edge and a trailing edge. The leading edge is the upstream edge of the blade and the trailing edge is the downstream edge of the blade. $\theta$ is the camber angle, that is, the angle in degrees between a tangent to the camber line at the leading edge and a tangent to the camber line at the trailing edge of a blade section at the radial distance R. $\sigma$ is the solidity C/S (where C is chord length and S is the circumferential blade spacing) at the radial distance R. As shown in FIG. 2, H is the di-hedral distance of the trailing edge of a blade, at a radial distance R, from a datum plane perpendicular to the axis of rotation at the downstream surface of the band. The rate of change of H with respect to R, i.e., the slope dH/dR, can be determined at R. Of course, one of ordinary skill in the art will recognize that slope may be measured in other manners, for example, with respect to other datum planes.

Figure 1:
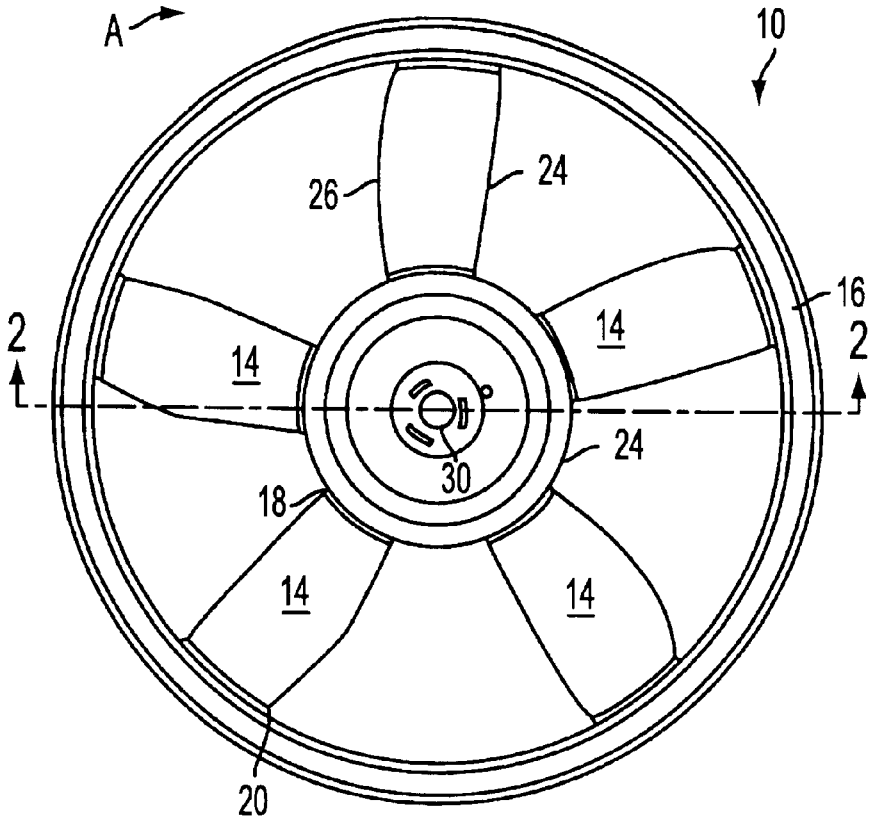
FIG. 1 is front view of an axial flow fan provided in accordance with the principles of the present invention.

With reference to FIGS. 1–2, an axial flow fan, generally indicated at 10, is shown in accordance with the principles of the present invention. The fan 10 is a large fan (e.g., about 420 to 520 mm in diameter) and is constructed and arranged to be mounted adjacent to a heat exchanger (not shown). Fan 10 includes an annular hub 12, fan blades 14 and a circular band 16. Each fan blade 14 has blade root 18 defined at the hub 12 and a blade tip 20 defined at the band 16. Hub 12 is concentric to a rotational axis 22 (FIG. 2). In the illustrated embodiment, five fan blades 14 are distributed circumferentially around hub 12 and are evenly spaced. However, the blades 14 need not be spaced evenly. Blades 14 extend radially from hub 12 to the annular band 16, with the distance between the two ends of blades 14 referred to as blade length or span. The distance from the rotational axis 22 to locations along blades 14 is referred to as blade section radius R. The direction of rotation of the fan 10 is in the direction of arrow A in FIG. 1. Thus, each blade 14 has leading edge 24, a trailing edge 26, and a shape configured to produce an airflow when fan 10 is rotated about rotational axis 22.

An aspect of the invention pertains to the slope of trailing edge 26 of each blade 14 as each blade extends radially and axially away from fan hub 12. This slope can be expressed relative to a datum plane perpendicular to rotational axis 22. As is shown in FIG. 2, the distance H of trailing edge 26 is measured from datum plane B which is perpendicular to rotational axis 22 through downstream surface 28 of the band 16. Values of H are measured at distances R to determine slope, or dH/dR. As one of skill in the art will recognize, slope can also be measured by other methods.

In general, fan 10 is supported and securely coupled to a shaft (not shown) passing fully or partially through an aperture 30 in the hub 12. Alternatively, the shaft may be securely coupled to fan 10 by other means, such as a screw passing through hub 12 along rotational axis 22 and into the shaft or by a twist-lock or bayonet fitting. The shaft is rotatably driven by a power source (not shown) such as an electric motor or vehicle engine. An appropriate gearing or transmission, such as a belt, chain or direct coupling drive, may couple the power source to the shaft. In the case of an electric motor, the output shaft of the motor may be used also as the shaft for the fan.

As the shaft is rotated about rotational axis 22 by the power source, torque is applied to hub 12, blades 14 and band 16, and fan 10 rotates about rotational axis 22. Upon rotation of fan 10, blades 14 generate an airflow which may serve to remove heat energy from a liquid, such as a coolant, flowing through heat exchanger. Fan 10 may be located on the upstream or downstream side of a heat exchanger to push or pull air through the heat exchanger depending upon the requirements of the particular configuration.

The components of the invention may be constructed of commonly available materials. By way of example only, fan 10 may be an integrally molded piece fabricated from polycarbonate 20% G.F. Hydex 4320, or from mineral or glass reinforced polyaimide 6/6 (e.g., DuPont Minlon 22C®), or from other composite or plastics known in the art, or from lightweight metals such as aluminum or titanium.

Each blade 14 has substantially the parameters defined by a particular set of values for R (the radial distance from the rotational axis), C (the chord length of the blade at the radial distance R), ξ (the stagger angle in degrees of a blade section at the radial distance R), H (the dihedral distance of the downstream edge of the blade, at the radial distance R, from a plane perpendicular to the axis of rotation at the downstream surface of the band), and T the thickness as a percent of chord C.

The following data defines geometry of a blade 14 of the high speed, low torque fan 10 of the invention.

| Radius R mm | Stagger ξ Degrees | Chord C mm | Thickness T % of Chord | Camber θ | Dihedral H mm |
|---|---|---|---|---|---|
| 85.0 | 76.0 | 55.80 | 0.105 | 15.00 | 7.00 |
| 102.8 | 72.0 | 63.25 | 0.0928 | 15.00 | 6.77 |
| 116.2 | 71.5 | 68.59 | 0.0836 | 15.00 | 6.54 |
| 127.5 | 70.7 | 72.39 | 0.0773 | 15.00 | 6.28 |
| 138.9 | 71.1 | 75.33 | 0.0725 | 15.00 | 5.97 |
| 150.3 | 72.0 | 77.43 | 0.0687 | 15.00 | 5.55 |
| 161.6 | 72.9 | 78.29 | 0.0654 | 15.00 | 5.06 |
| 173.0 | 73.9 | 78.02 | 0.063 | 15.00 | 4.40 |
| 184.3 | 74.4 | 76.94 | 0.0612 | 15.00 | 3.72 |
| 195.7 | 75.1 | 74.37 | 0.0606 | 15.00 | 2.85 |
| 207.0 | 76.7 | 69.40 | 0.0618 | 15.00 | 1.74 |
| 220.5 | 78.6 | 62.33 | 0.0715 | 15.00 | 0.00 |

The following defines dimensionless data of a blade 14 of the high speed, low torque fan 10 of the invention.

| Blade Section Radius/Tip Radius $r = R/R_{tip}$ | Stagger ξ Degrees | Solidity σ |
|---|---|---|
| 38.5% | 76.0 | 0.522 |
| 46.6% | 72.0 | 0.490 |
| 52.7% | 71.5 | 0.470 |
| 57.8% | 70.7 | 0.452 |
| 63.0% | 71.1 | 0.432 |
| 68.1% | 72.0 | 0.410 |
| 73.3% | 72.9 | 0.385 |
| 78.4% | 73.9 | 0.359 |
| 83.6% | 74.4 | 0.332 |
| 88.7% | 75.1 | 0.302 |
| 93.9% | 76.7 | 0.267 |
| 100.0% | 78.6 | 0.225 |

It is noted that $R_{tip}$ is the radius form the rotational axis at the blade tip.

Figure 4:
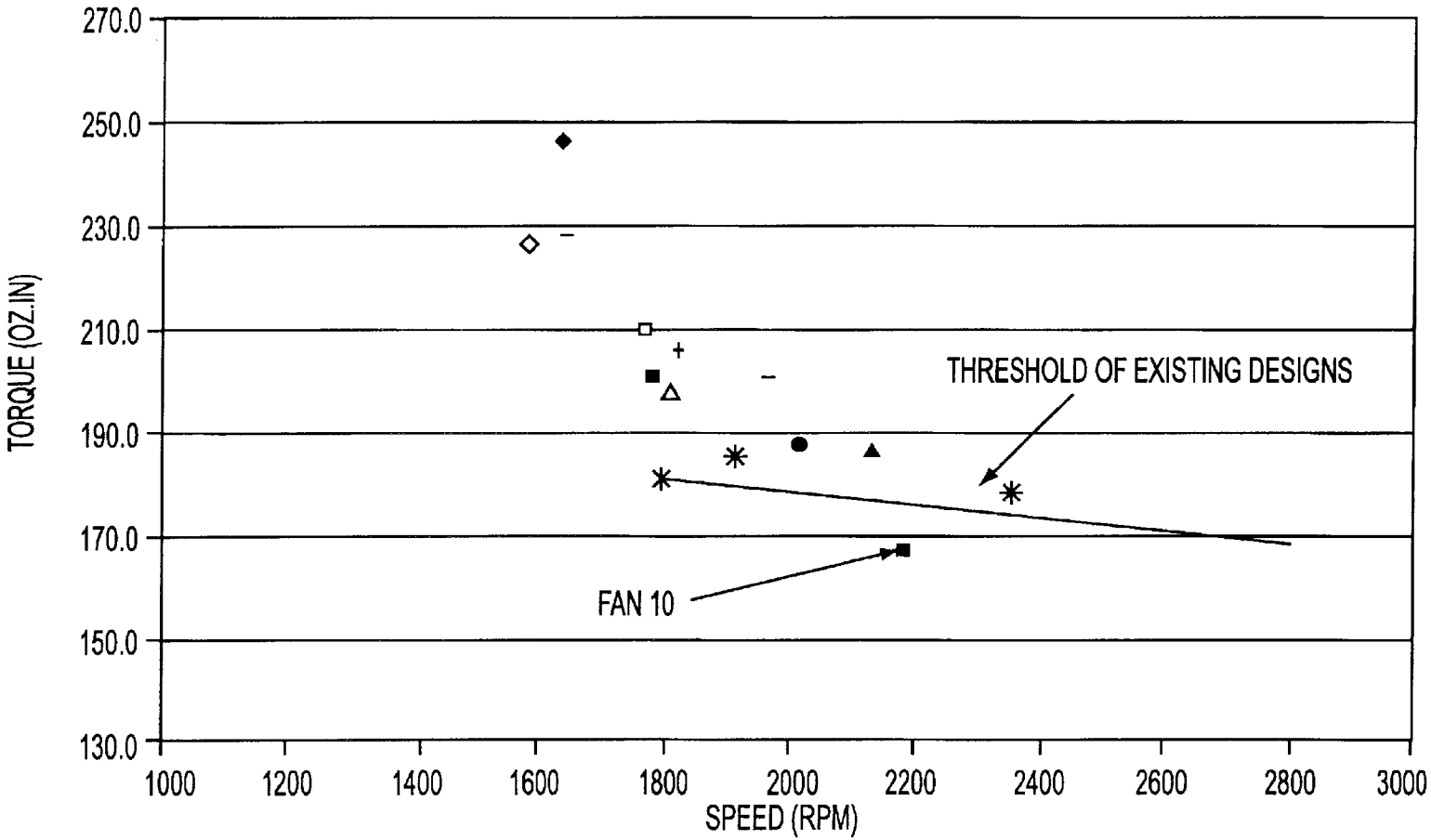
FIG. 4 is a graph of torque verses fan speed of conventional fans and a fan provided in accordance with the invention.
Figure 5:
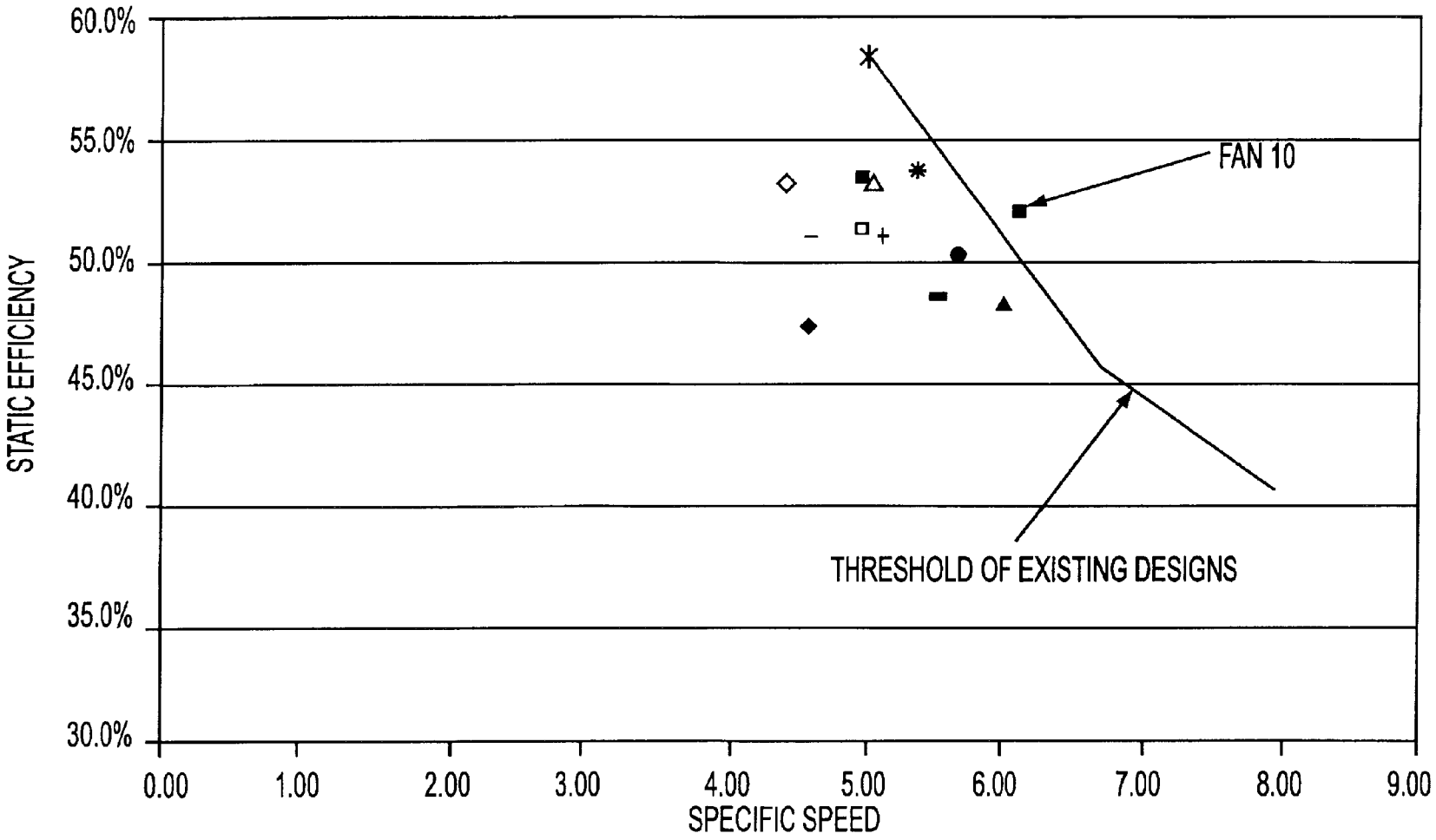
FIG. 5 is a graph of peak efficiency verses fan speed of conventional fans and a fan provided in accordance with the invention.
Figure 6:
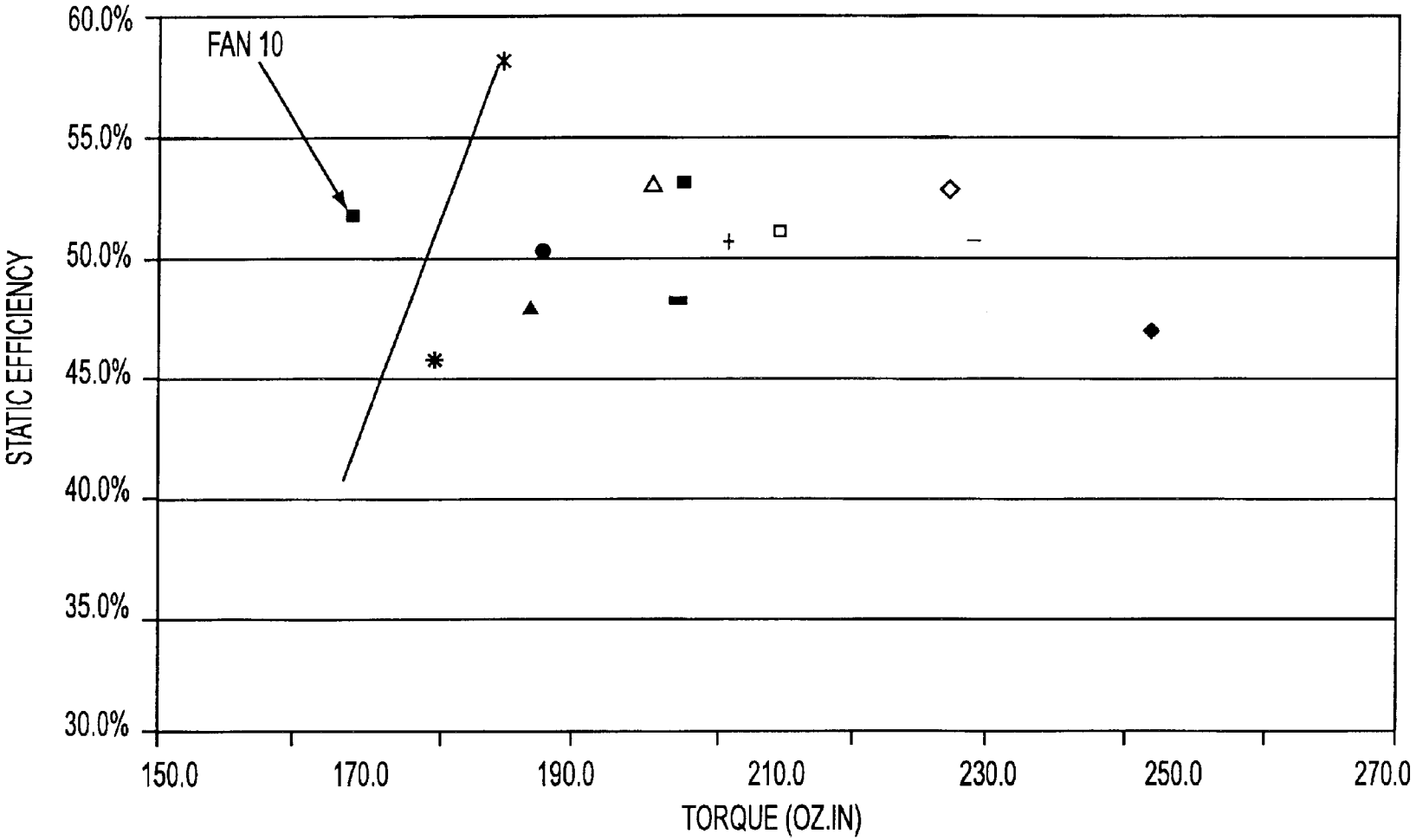
FIG. 6 is a graph of peak efficiency verses fan torque of conventional fans and a fan provided in accordance with the invention.
Figure 7:
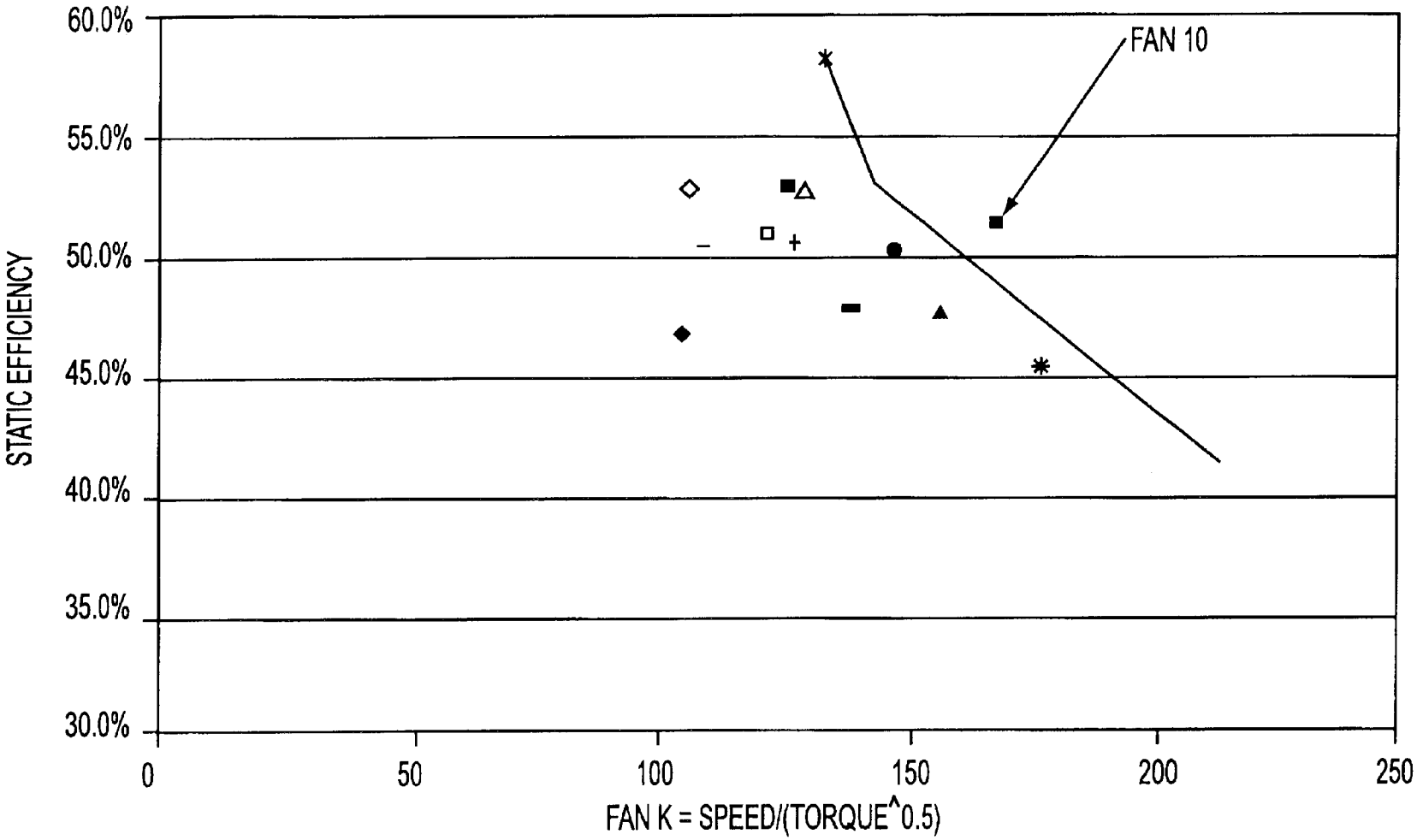
FIG. 7 is a graph which relates speed, torque and efficiency of conventional fans and a fan provided in accordance with the invention.

FIGS. 4–7 show data of a fan 10 of the invention, having a diameter of 460 mm, as compared to data of conventional fans. With reference to FIG. 4, fan 10 operates at low torque, e.g., about 168 oz. in. at high speed, e.g., about 2181 rpm. Furthermore, as shown in FIG. 5, the fan 10 has a static efficiency of about 52% at 2181 rpm (6.16 specific speed). Still further, as shown in FIG. 6, the fan 10 has a static efficiency of about 52% at a torque of about 168 oz. in. FIG. 7 shows relationships between speed, torque and static efficiency for the fan 10 and conventional fans.

Thus, the axial flow fan 10 is configured for operating at high speed yet at low torque to improve module efficiency by allowing the motor driving the fan to operate more efficiently when a small diameter fan cannot be used.

The foregoing preferred embodiments have been shown and described for the purposes of illustrating the structural and functional principles of the present invention, as well as illustrating the methods of employing the preferred embodiments and are subject to change without departing from such principles.

Therefore, this invention includes all modifications encompassed within the spirit of the following claims.

What is claimed is:

1. An axial flow fan characterized by operating at high speed and low torque for producing airflow through an engine compartment of a vehicle comprising:

a hub rotatable about an axis;

an annular band concentric with the hub and spaced radially outward from the hub;

a plurality of fan blades distributed circumferentially around the hub and extending radially from the hub to the annular band, wherein each blade has substantially the parameters defined by

| Blade Section Radius/Tip Radius $r = R/R_{tip}$ | Stagger $\xi$ Degrees | Solidity $\sigma$ |
|---|---|---|
| 38.5% | 76.0 | 0.522 |
| 46.6% | 72.0 | 0.490 |
| 52.7% | 71.5 | 0.470 |
| 57.8% | 70.7 | 0.452 |
| 63.0% | 71.1 | 0.432 |
| 68.1% | 72.0 | 0.410 |
| 73.3% | 72.9 | 0.385 |
| 78.4% | 73.9 | 0.359 |
| 83.6% | 74.4 | 0.332 |
| 88.7% | 75.1 | 0.302 |
| 93.9% | 76.7 | 0.267 |
| 100.0% | 78.6 | 0.225 |

wherein r is the non-dimensional radius from the rotational axis, ($r=R/R_{tip}$ with R being the radius from the rotational axis and $R_{tip}$ being the radius from the rotational axis at the blade tip), $\xi$ is the stagger angle of the blade at the radial distance R, and $\sigma$ is the solidity C/S, with C being chord length and S being the circumferential blade spacing at the radial distance R.

2. The fan according to claim 1, wherein said blades are distributed evenly about the hub.

3. The fan according to claim 1, wherein said hub, said blades and said band are made integral.

4. The fan according to claim 1, wherein five blades are provided.

5. The fan according to claim 1, wherein a diameter of the fan is in a range of about 420 to 520 mm.

6. An axial flow fan characterized by operating at high speed and low torque for producing airflow through an engine compartment of a vehicle comprising:

a hub rotatable about an axis;

an annular band concentric with the hub and spaced radially outward from the hub;

a plurality of fan blades distributed circumferentially around the hub and extending radially from the hub to the annular band, wherein each blade has substantially the parameters defined by

| Radius R mm | Stagger $\xi$ Degrees | Chord C mm | Thickness T % of Chord | Camber $\theta$ |
|---|---|---|---|---|
| 85.0 | 76.0 | 55.80 | 0.105 | 15.00 |
| 102.8 | 72.0 | 63.25 | 0.0928 | 15.00 |
| 116.2 | 71.5 | 68.59 | 0.0836 | 15.00 |
| 127.5 | 70.7 | 72.39 | 0.0773 | 15.00 |
| 138.9 | 71.1 | 75.33 | 0.0725 | 15.00 |
| 150.3 | 72.0 | 77.43 | 0.0687 | 15.00 |
| 161.6 | 72.9 | 78.29 | 0.0654 | 15.00 |
| 173.0 | 73.9 | 78.02 | 0.063 | 15.00 |
| 184.3 | 74.4 | 76.94 | 0.0612 | 15.00 |
| 195.7 | 75.1 | 74.37 | 0.0606 | 15.00 |
| 207.0 | 76.7 | 69.40 | 0.0618 | 15.00 |
| 220.5 | 78.6 | 62.33 | 0.0715 | 15.00 |

wherein

R is the non-dimensional radius from the rotational axis, $\xi$ is the stagger angle of the blade at the radial distance R, C is the chord length at the radial distance R, T is the thickness as a percent of chord C, and $\theta$ is the chamber angle of the blade at the radial distance R.

7. The fan according to claim 6, wherein said blades are distributed evenly about the hub.

8. The fan according to claim 6, wherein said hub, said blades and said band are made integral.

9. The fan according to claim 6, wherein five blades are provided.

10. The fan according to claim 6, wherein a diameter of the fan is in a range of about 420 to 520 mm.

* * * * *